US011060674B1

(12) United States Patent
Liu

(10) Patent No.: US 11,060,674 B1
(45) Date of Patent: Jul. 13, 2021

(54) FOUR-WIRE LIGHT STRING

(71) Applicant: Shenzhen Hongyuan Optical Technology Co., Ltd., Shenzhen (CN)

(72) Inventor: Fada Liu, Shenzhen (CN)

(73) Assignee: Shenzhen Hongyuan Optical Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/220,897

(22) Filed: Apr. 1, 2021

(51) Int. Cl.

| | |
|---|---|
| ***F21S 4/26*** | (2016.01) |
| ***F21V 23/00*** | (2015.01) |
| ***F21V 23/06*** | (2006.01) |
| ***F21Y 103/10*** | (2016.01) |
| ***F21Y 115/10*** | (2016.01) |

(52) U.S. Cl.
CPC ..... *F21S 4/26* (2016.01); *F21V 23/001* (2013.01); *F21V 23/06* (2013.01); *F21Y 2103/10* (2016.08); *F21Y 2115/10* (2016.08)

(58) Field of Classification Search
CPC ..... F21S 4/00; F21S 4/10; F21S 4/26; F21V 23/001; F21V 23/06; F21Y 2103/10; F21Y 2115/10
See application file for complete search history.

(56) References Cited

U.S. PATENT DOCUMENTS

| | | | | |
|---|---|---|---|---|
| 6,367,952 | B1 | 4/2002 | Gibboney, Jr. | |
| 8,957,590 | B1 | 2/2015 | Peng | |
| 9,347,630 | B2 | 5/2016 | Neuman | |
| 10,400,963 | B2 * | 9/2019 | Zhao | F21S 4/20 |
| 10,429,016 | B1 * | 10/2019 | Yang | H05B 45/56 |
| 2006/0158883 | A1 * | 7/2006 | Wu | F21V 23/00 362/249.16 |
| 2019/0211980 | A1 * | 7/2019 | Pan | F21V 23/002 |

* cited by examiner

*Primary Examiner* — Peggy A Neils
(74) *Attorney, Agent, or Firm* — True Shepherd LLC; Andrew C. Cheng

(57) ABSTRACT

A four-wire light string includes a first interface, a second interface, a plurality of LED lights connected between the first and second interfaces, a first conductive wire and a second conductive wire that are directly connected to the first and second interfaces, a plurality of third conductive wires each connected to a positive pole of the LED light, and a plurality of fourth conductive wires each connected to a negative pole of the LED light. Each four-wire light string constitutes a basic unit. When no additional basic unit is adopted, a current does not flow through the first conductive wire and the second conductive wire, but is directly connected to positive and negative poles of a power supply. Each basic unit has a small heating loss on the conductive wire, and adding more basic units will not cause a voltage drop, so that the light strings have basically the same brightness.

9 Claims, 2 Drawing Sheets

FOUR-WIRE LIGHT STRING

TECHNICAL FIELD

The utility model relates to the technical field of light-emitting diode (LED) light strings, and in particular, to a four-wire light string.

BACKGROUND

People can often see a lot of small LED lights hung on the trees in shopping malls or on the streets, and sometimes hundreds or thousands of them are connected to a wire. Usually these lights are connected in the following two modes:

In the first mode, all LED lights are connected in parallel between the positive and negative power cables, and two conductive wires are used in this case. In this solution, a specified quantity of LED lights, such as 200, is considered as a basic unit, and then basic units can be directly connected through connectors for unlimited expansion. However, this solution has a disadvantage: lights closer to a power interface are bright, while lights farther away from the power interface are dim. This is because the lights are connected in parallel. Without considering resistance of conductive wires, voltage on each light is the same, and theoretically brightness is the same. However, when the conductive wire is tens of meters or even longer, the resistance of the conductive wire cannot be ignored. Under the same input power, a light farther from a power input interface has a greater wire resistance and consumes more power, so that lower power is allocated to the light and the light is dimmer. As a result, brightness of the light string is uneven.

In the second mode, improvements are made based on the first mode, and three conductive wires are used. In this solution, one basic unit contains series-connected light strings, with all lights in each string connected in parallel. Basic units can be added unlimitedly. However, lights at both ends are bright and those in the middle are dim. Uneven brightness still exists.

Both of the above two connection modes of the LED light string have the shortcoming of uneven brightness. Therefore, a four-wire string light is proposed to solve the problem in the prior art.

SUMMARY

The utility model proposes a four-wire light string, to solve a problem of uneven brightness of LED lights in an LED light string in the prior art.

To achieve the foregoing objective, the utility model adopts the following technical solutions:

A four-wire light string includes a first interface, a second interface, a plurality of LED lights connected between the first interface and the second interface, a first conductive wire and a second conductive wire that are directly connected to the first interface and the second interface, a plurality of third conductive wires each connected to a positive pole of the LED light, and a plurality of fourth conductive wires each connected to a negative pole of the LED light, where at least one third conductive wire is connected to a positive pole of a power supply, and at least one fourth conductive wire is connected to a negative pole of the power supply.

Preferably, a plurality of LED lights form n series-connected light strings, and each light string includes at least two parallel-connected LED lights, where $n \geq 1$.

Preferably, $5 \leq n \leq 30$.

Preferably, the first conductive wire and the second conductive wire are arranged in parallel, and a plurality of the LED lights are linearly and equidistantly distributed between the first conductive wire and the second conductive wire, and have a linear extension direction parallel to the first conductive wire and the second conductive wire.

Preferably, the first interface is provided with a first connection structure, the second interface is provided with a second connection structure capable of coupling with the first connection structure, and a plurality of four-wire light strings are connected through the first connection structure and the second connection structure.

Preferably, two conductive rods are provided at the first connection structure, two conductive jacks are provided at the second connection structure, and the two conductive jacks and the two conductive rods are electrically connected to two ends of the first conductive wire and two ends of the second conductive wire, respectively. When the first connection structure is coupled to the second connection structure, the conductive rods are inserted into and electrically connected to the conductive jacks.

Preferably, the first connection structure is a connecting sleeve that is rotatably sleeved on an outer side of the light string, an inner side of the connecting sleeve is engraved with internal threads, an outer side of the second connection structure is engraved with external threads, and the two connection structures are fixed through the internal and external threads.

Preferably, the first connection structure is a connecting sleeve that is rotatably sleeved on an outer side of the light string, a slot is provided on a surface of the connecting sleeve, a buckle is provided on an outer side of the second connection structure, and the two connection structures are clamped securely.

Preferably, a power entry module is further included, and the power entry module is coupled to the first connection structure.

Compared with the prior art, the utility model provides a four-wire light string, which has the following beneficial effects:

1. In the four-wire light string, each four-wire light string constitutes a basic unit. Without expanding a next basic unit, a current does not flow through the first conductive wire and the second conductive wire, but is directly connected to the positive and negative poles of the power supply through the first interface and the second interface. Each basic unit has a small heating loss on the conductive wire, and adding more basic units will not cause a voltage drop, that is, currents do not flow through the conductive wires of the previous basic units, so brightness of subsequently added lights is the same as that of the original lights. Such a structure ensures that the brightness of each light string is basically the same, thereby solving the problem of uneven brightness of LED lights in an LED light string in the prior art.

2. In the four-wire light string, a plurality of light strings is connected in series, so that currents flowing through the light strings are the same, ensuring the same brightness of the light strings. LED lights in each light string are connected in parallel. If an LED light is disconnected, other LED lights in the light string can still light up, so that the brightness of each light string is basically the same.

3. In the four-wire light string, the first conductive wire and the second conductive wire are arranged in parallel, a plurality of LED lights are linearly and equidistantly distributed between the first conductive wire and the second conductive wire, and have a linear extension direction parallel to the first conductive wire and the second conductive wire. This ensures that an arrangement direction of the LED lights is parallel to an extension direction of the four-wire light string, so that the LED lights in the light string are more evenly distributed.

Figure 1:
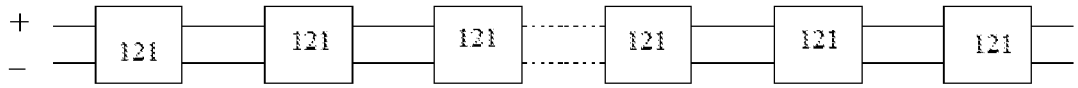
FIG. 1 of Prior Art
FIG. 1 is a schematic diagram of a connection structure of a two-wire light string in the prior art.

In the figure, 101. first interface, 102. second interface, 121. LED light, 111. first conductive wire, 112. second conductive wire, 113. third conductive wire, 114. fourth conductive wire, 120. light string, 1011. conductive rod, 1012. conductive jack, 1013. connecting sleeve, 1014. slot, and 1015. buckle.

DETAILED DESCRIPTION

A clear and complete description of the technical solutions in the examples of the utility model will be given below, in combination with the accompanying drawings in the examples of the utility model. Apparently, the examples described below are a part, but not all, of the examples of the utility model.

In the description of the utility model, it should be understood that orientations or position relationships indicated by terms "upper", "lower", "front", "rear", "left", "right", "top", "bottom", "inside", "outside", etc. are orientation or position relationships as shown in the drawings, and these terms are just used to facilitate description of the utility model and simplify the description, but not to indicate or imply that the mentioned device or elements must have a specific orientation and must be established and operated in a specific orientation, and thus, these terms cannot be understood as a limitation to the utility model.

FIG. 1 shows a case that all LED lights are connected in parallel between positive and negative power cables in the prior art, and two conductive wires are used. In this solution, a specified quantity of LED lights, such as 200, is made into a basic unit, and then basic units can be directly connected through connectors for unlimited expansion. However, this solution has a disadvantage: lights closer to a power interface are bright, but lights farther away from the power interface are dim. These lights are connected in parallel. Without considering resistance of conductive wires, voltage on each light is the same, and theoretically brightness is the same. However, when the conductive wire is tens of meters or even longer, the resistance of the conductive wire cannot be ignored. Under the same input power, a light farther from a power input interface has a greater wire resistance and consumes more power, so that lower power is allocated to the light and the light is dimmer. As a result, brightness of the light string is uneven.

Figure 2:
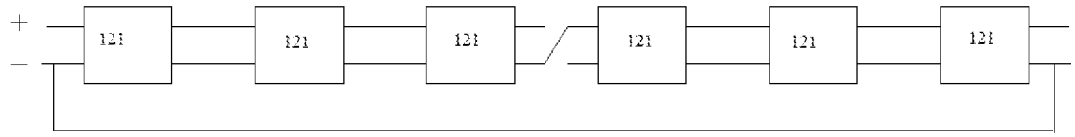
FIG. 2 of Prior Art
FIG. 2 is a schematic diagram of a connection structure of a three-wire light string in the prior art.

FIG. 2 shows a second case in the prior art: improvements are made based on the first solution and three wires are used. In this solution, one basic unit contains two series-connected light strings, with all lights in each string connected in parallel. Basic units can be added unlimitedly. However, lights at both ends are bright and lights in the middle are dim, and uneven brightness still exists.

Figure 3:
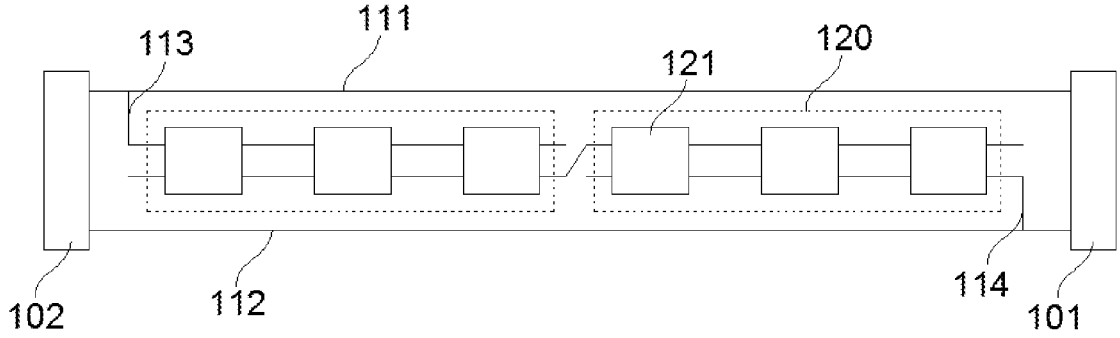
FIG. 3 is a schematic structural diagram of a four-wire light string in the utility model.

To solve the problem of uneven brightness of a light string, the utility model adopts the following solution. As shown in FIG. 3, a four-wire light string includes a first interface 101, a second interface 102, a plurality of LED lights 121 connected between the first interface 101 and the second interface 102, a first conductive wire 111 and a second conductive wire 112 that are directly connected to the first interface 101 and the second interface 102, a plurality of third conductive wires 113 each connected to a positive pole of the LED light 121, and a plurality of fourth conductive wires 114 each connected to a negative pole of the LED light 121. At least one third conductive wire 113 is connected to a positive pole of a power supply, and at least one fourth conductive wire 114 is connected to a negative pole of the power supply. It should be noted that a plurality of LED lights 121 form n series-connected light strings 120, and each light string 120 includes at least two parallel-connected LED lights 121, where $n \geq 1$. For example, a quantity n of light strings 120 may be any number ranging from 5 to 30. In this embodiment, there are two light strings 120, and three LED lights 121 in each light string 120. It should be noted that each four-wire light string constitutes a basic unit. When no additional basic unit is adopted, a current does not flow through the first conductive wire 111 and the second conductive wire 112, but is directly connected to the positive and negative poles of the power supply through the first interface 101 and the second interface 102. When a next basic unit is added, the next basic unit needs to be connected to the positive pole of the power supply through the first conductive wire 111. This means each basic unit has a small heating loss on the conductive wire, and adding more basic units will not cause a voltage drop. If the next basic unit is directly added without through the first conductive wire 111 and the second conductive wire 112, currents will flow through each of the previous basic units. Assuming that an equivalent resistor of the conductive wire is 1 ohm, if there is no first conductive wire 111, the basic unit includes 100 LED lights 121 and is expanded with 100 LED lights 121, then currents of these 200 LED lights 121 will all flow through the conductive wire connected to the positive pole, leading to a high voltage on the resistor on this conductive wire. The more the LED lights are connected, the lower the voltage and the brightness of the LED lights are. If the first conductive wire 111 is used, and the equivalent resistor is still 1 ohm, then currents of the 100 LED lights 121 of the first basic unit flow through this 1-ohm resistor, and the basic unit lights up. Then 100 LED lights 121 are added. Currents of the added LED lights do not flow through the conductive wire of the previous basic unit, and brightness of the added LED lights is the same as that of the previous LED lights. In addition, because the plurality of light strings 120 are connected in series, currents flowing through the light strings 120 are the same, ensuring the same brightness of the light strings 120. The LED lights 121 in each light string 120 are connected in parallel. If one LED light 121 is disconnected, the other LED lights 121 in the light string 120 can still light up.

Figure 4:
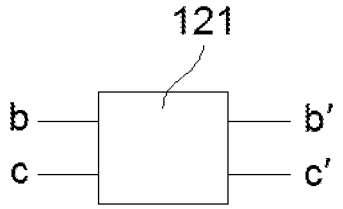
FIG. 4 is a schematic structural diagram of an LED light in the utility model.

It should be noted that an LED light, namely a light-emitting diode, is a semiconductor electronic component that can convert electrical energy into light energy. It is made of a compound containing gallium Ga, arsenic As, phosphorus P, nitrogen N, and the like. With the continuous development of technology, LEDs have been widely used in displays, televisions, lighting decoration and lighting. The LED lights herein are products in the prior art. Actual dimensions of each LED light is (0.6 mm, 0.3 mm), or (0.8 mm, 0.5 mm), or (2.8 mm, 3.5 mm), where a value before the comma in parentheses is length, and a value behind the comma is width. In other words, the LED light has a length of 0.6 mm and a width of 0.3 mm, or has a length of 0.8 mm and a width of 0.5 mm, or has a length of 2.8 mm and a width of 3.5 mm. In this embodiment, to make the LED lights 121 parallel to the extension direction of the four-wire light string, as shown in FIG. 3, the first conductive wire 111 and the second conductive wire 112 are arranged in parallel, the plurality of LED lights 121 are linearly and equidistantly distributed between the first conductive wire 111 and the second conductive wire 112, and the linear extension direction is parallel to the first conductive wire 111 and the second conductive wire 112. As shown in FIG. 4, each LED light 121 includes a pin b, a pin b', a pin c, and a pin c', where the pin b and the pin b' are positive pins of the LED light 121 and are internally interconnected, and the pin c and the pin c' are negative pins of the LED light 121 and are internally interconnected. In this embodiment, in each light string 120, LED lights 121 are connected in parallel by connecting pins b to pins b'; between two adjacent light strings 120, LED lights 121 are connected by connecting pins c' to pins b, to implement series connection between the light strings 120; the pins b of the LED lights 121 at one end of the four-wire light string are connected through the third conductive wire 113 and the first conductive wire 111, and the pins c' of the LED lights 121 at the other end of the four-wire light string are connected through the fourth conductive wire 114 and the second conductive wire 112. This implements the serial and parallel connection of the entire circuit, and ensures that an arrangement direction of the LED lights 121 is parallel to the extension direction of the four-wire light string.

Figure 5:
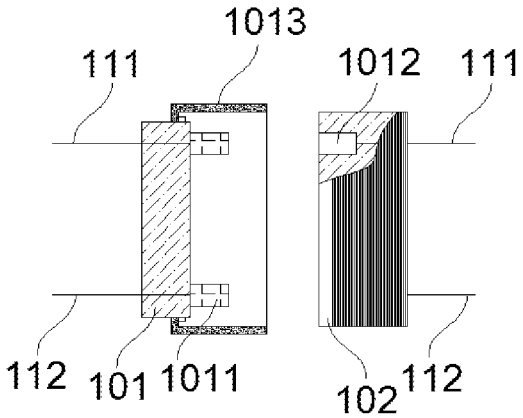
FIG. 5 is a schematic structural diagram of a first embodiment of a connection structure in the utility model.

To expand the four-wire light string, as shown in FIG. 5, the first interface 101 is provided with a first connection structure, and the second interface 102 is provided with a second connection structure capable of coupling with the first connection structure. A plurality of four-wire light strings is connected through the first connection structure and the second connection structure. Two conductive rods 1011 are provided at the first connection structure, two conductive jacks 1012 are provided at the second connection structure, and the two conductive jacks 1012 and the two conductive rods 1011 are electrically connected to two ends of the first conductive wire 111 and two ends of the second conductive wire 112, respectively. When the first connection structure is coupled with the second connection structure, the conductive rods are inserted into and electrically connected to the conductive jacks. It should be noted that two four-wire light strings can be connected to each other by inserting the conductive rods 1011 at the first connection structure into the conductive jacks 1012 at the second connection structure, thereby realizing expansion of four-wire light strings. To ensure reliable connection between the conductive rods 1011 and the conductive jacks 1012, the connection structures may be fixed through screwing. For example, the first connection structure is a connecting sleeve 1013 rotatably sleeved on an outer side of the light string, an inner side of the connecting sleeve 1013 is engraved with internal threads, an outer side of the second connection structure is engraved with external threads, and the two connection structures are fixed by screwing through the internal and external threads. In this way, the conductive rods 1011 and the conductive jacks 1012 of two four-wire light strings can be reliably connected by fitting the conductive rods 1011 into the conductive jacks 1012 and screwing the connecting sleeve 1013 to the outer side of the second connection structure. Certainly, upon power-on, the four-wire light string further includes a power entry module, and the power entry module is coupled to one of the connection structures, such as the first connection structure, to achieve electrical connection between the power entry module and the first interface 101 or the second interface 102 for power supply.

Figure 6:
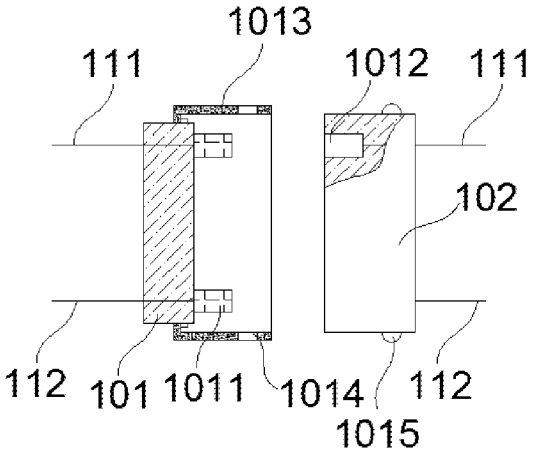
FIG. 6 is a schematic structural diagram of a second embodiment of a connection structure in the utility model.

In another embodiment, the two connection structures may be connected through buckling. As shown in FIG. 6, the first connection structure is a connecting sleeve 1013 that is rotatably sleeved on an outer side of the light string, and a slot 1014 is provided on a surface of the connecting sleeve 1013, a buckle (1015) is provided on an outer side of the second connection structure, and the two connection structures are clamped securely. In this way, the two connection structures can be quickly fixed when being plugged or unplugged along the connecting sleeve 1013, thereby speeding up the connection.

In the utility model, when using the four-wire light string, an operator first connects the power entry module to one of the interfaces of the four-wire light string. In this case, the first conductive wire 111 and the second conductive wire 112 are respectively connected to the positive and negative poles of the power supply. Because a plurality of light strings 120 are connected in series, currents flowing through the light strings 120 are the same, ensuring the same brightness of the light strings 120. The LED lights 121 in each light string 120 are connected in parallel. If one LED light 121 is disconnected, other LED lights 121 in the light string 120 can still light up, thereby ensuring that the light strings have basically the same brightness. When light strings need to be expanded, a plurality of four-wire light strings is connected through the first connection structure and the second connection structure. For example, the first connection structure is a connecting sleeve 1013 that is rotatably sleeved on an outer side of the light string, an inner side of the connecting sleeve 1013 is engraved with internal threads, an outer side of the second connection structure is engraved with external threads, and the two connection structures are fixed by screwing through the internal and external threads. In this way, the conductive rods 1011 and the conductive jacks 1012 of two four-wire light strings can be reliably connected by fitting the conductive rods 1011 into the conductive jacks 1012 and screwing the connecting sleeve 1013 to the outer side of the second connection structure. In addition, each four-wire string light constitutes a basic unit. When no additional basic unit is adopted, a current does not flow through the first conductive wire 111 and the second conductive wire 112, but is directly connected to the positive and negative poles of the power supply through the first interface 101 and the second interface 102. Each basic unit has a small heating loss on the conductive wire, and adding more basic units will not cause a voltage drop, that is, currents do not flow through the conductive wires of the previous basic unit, so brightness of subsequently added lights is the same as that of the original lights. In this way, the problem of uneven brightness of LED lights in an LED light string in the prior art is solved.

The above merely describes specific examples of the utility model, but the protection scope of the utility model is not limited thereto. A person skilled in the art can easily conceive modifications or replacements according to the technical solutions and ideas of the utility model within the technical scope of the utility model, and these modifications or replacements shall fall within the protection scope of the utility model.

What is claimed is:

1. A four-wire light string, comprising a first interface (101), a second interface (102), a plurality of light-emitting diode (LED) lights (121) connected between the first interface (101) and the second interface (102), a first conductive wire (111) and a second conductive wire (112) that are directly connected to the first interface (101) and the second interface (102), a plurality of third conductive wires (113) each connected to a positive pole of a LED light (121), and a plurality of fourth conductive wires (114) each connected to a negative pole of the LED light (121), wherein at least one third conductive wire (113) is connected to a positive pole of a power supply, and at least one fourth conductive wire (114) is connected to a negative pole of the power supply.

2. The four-wire light string according to claim 1, wherein the plurality of LED lights (121) form n series-connected light strings (120), and each light string (120) comprises at least two parallel-connected LED lights (121), wherein $n \geq 1$.

3. The four-wire light string according to claim 2, wherein $5 \leq n \leq 30$.

4. The four-wire light string according to claim 3, wherein the first conductive wire (111) and the second conductive wire (112) are arranged in parallel, the plurality of LED lights (121) are linearly and equidistantly distributed between the first conductive wire (111) and the second conductive wire (112), and have a linear extension direction parallel to the first conductive wire (111) and the second conductive wire (112).

5. The four-wire light string according to claim 1, wherein the first interface (101) is provided with a first connection structure, the second interface (102) is provided with a second connection structure capable of coupling with the first connection structure, and the first connection structure and the second connection structure are configured for extension connection between a plurality of four-wire light strings.

6. The four-wire light string according to claim 5, wherein two conductive rods (1011) are provided at the first connection structure, two conductive jacks (1012) are provided at the second connection structure, and the two conductive jacks (1012) and the two conductive rods (1011) are electrically connected to two ends of the first conductive wire (111) and two ends of the second conductive wire (112), respectively; and when the first connection structure is coupled to the second connection structure, the conductive rods are inserted into and electrically connected to the conductive jacks.

7. The four-wire light string according to claim 6, wherein the first connection structure is a connecting sleeve (1013) that is rotatably sleeved on an outer side of the light string, an inner side of the connecting sleeve (1013) is engraved with internal threads, an outer side of the second connection structure is engraved with external threads, and the two connection structures are fixed by screwing through the internal and external threads.

8. The four-wire light string according to claim 6, wherein the first connection structure is a connecting sleeve (1013) that is rotatably sleeved on an outer side of the light string, a slot (1014) is provided on a surface of the connecting sleeve (1013), a buckle (1015) is provided on an outer side of the second connection structure, and the two connection structures are clamped securely.

9. The four-wire light string according to claim 1, further comprising a power entry module, wherein the power entry module is coupled to the first connection structure.

* * * * *